United States Patent [19]

Tylko

[11] 3,936,586

[45] Feb. 3, 1976

[54] ARC FURNACES AND TO METHODS OF TREATING MATERIALS IN SUCH FURNACES

[75] Inventor: Josef Kazimierz Tylko, Faringdon, England

[73] Assignee: Tetronics Research and Development Co. Ltd., Faringdon, England

[22] Filed: Apr. 30, 1975

[21] Appl. No.: 572,956

[30] Foreign Application Priority Data

May 7, 1974 United Kingdom ..... 20160/74

[52] U.S. Cl. ..... 13/9 R; 219/121 P

[51] Int. Cl.[2] ..... H05B 7/10

[58] Field of Search ..... 13/1, 9, 31; 219/121 P

[56] References Cited

UNITED STATES PATENTS

| | | | |
|---|---|---|---|
| 3,449,505 | 6/1969 | Brzozowski et al. | 13/1 |
| 3,783,167 | 1/1974 | Tylko | 13/1 |
| 3,852,061 | 12/1974 | Wulff | 13/9 UX |

*Primary Examiner*—J. D. Miller
*Assistant Examiner*—Harry E. Moose, Jr.
*Attorney, Agent, or Firm*—Dennison, Dennison, Meserole & Pollack

[57] ABSTRACT

A plasma arc furnace in which an expanded plasma column is generated between at least one orbiting electrode moving in a substantially circular path and a stationary electrode. The orbiting electrode is directed towards the orbital axis so as to generate a plasma column having a portion of generally inverted conical shape in the vicinity of the orbiting electrode and feedstock is introduced into the upper end of the plasma column. The orbiting electrode may be directed across the orbital axis whereby the generated plasma column is in the form of two generally conical portions meeting at a common apex.

12 Claims, 2 Drawing Figures

ARC FURNACES AND TO METHODS OF TREATING MATERIALS IN SUCH FURNACES

Figure 1:
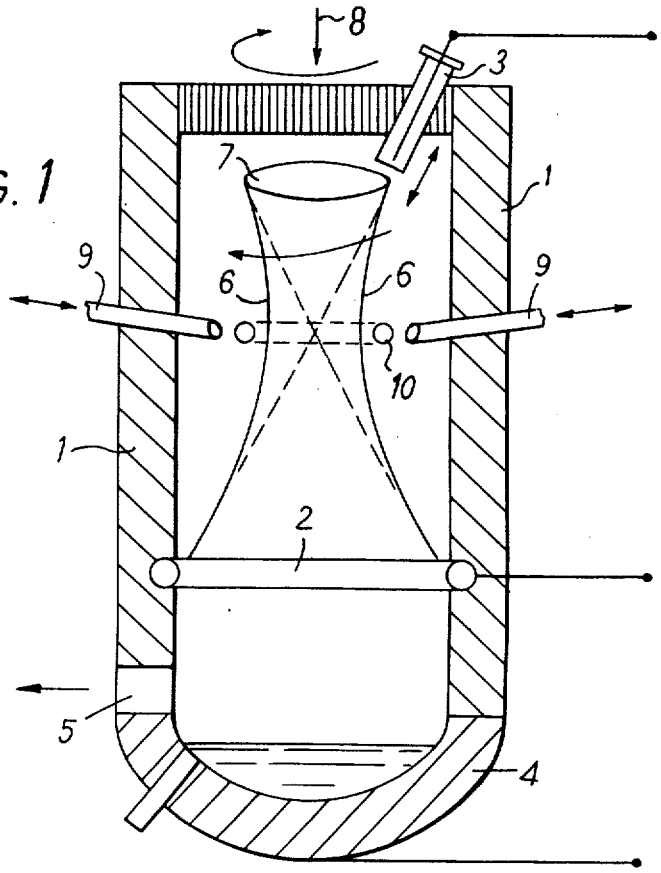

The present invention relates to plasma arc furnaces and in particular to procedures for treatment of particulate materials in plasma columns generated in such furnaces.

In British Pat. No. 1,390,351 there is described a plasma furnace in which an expanded plasma column is generated between an orbiting electrode and a ring-shaped stationary electrode, arranged coaxial with the orbit axis of the orbiting electrode and in a plane parallel with the path of said orbiting electrode. In apparatus of that type an unexpanded viscous column of plasma is formed when the orbital speed of the orbital electrode is low. When the angular speed of the orbital electrode in its orbit is sufficiently increased, an expanded precessing plasma column is generated and fills most, if not all, of the space lying between the plane of the path of the orbiting electrode and the plane in which the stationary electrode lies. The advantage of the plasma arc column expanded in this manner is that it permits relatively large quantities of extraneous material, especially particulate solid materials, to be introduced into the plasma column without upsetting the stability of the plasma column, in order to initiate chemical and/or physical changes in such extraneous material in the high energy conditions existing in the plasma column.

In the preferred form of apparatus described in British Pat. No. 1,390,351 the orbiting electrode, usually a so-called plasma gun, moves in a circular path of substantially smaller diameter than the diameter of the stationary electrode, with the result that the plasma filled zone is in the form of a truncated cone. In order to establish the plasma column it is necessary to bring the tip of the orbiting electrode into close proximity with the ringshaped stationary electrode and in order to achieve that requirement in a simple way the orbiting electrode is constructed so as to be movable longitudinally along its own axis.

It will be realized that the orbiting electrode is directed towards the stationary electrode and therefore the orbiting electrode is inclined away from the axis of its orbit. In consequence, the space in the vicinity of the axis of rotation of the orbiting electrode immediately inwardly of the path of the tip of the electrode is swept by the outer end of the electrode structure. It is therefore impracticable to introduce feedstock into the plasma arc by means of a feed arranged on or close to the axis of the conical plasma column and in fact it is found desirable to introduce the feedstock in the form of a substantially continuous cylindrical curtain having a diameter larger than the path of the orbiting electrode in its operating or retracted position. In consequence the portion of the plasma column immediately adjacent the plasma gun is unoccupied by any particulate material.

It has now been appreciated, in accordance with the present invention, that various advantages would arise in a plasma arc furnace of this general type by arranging that the orbiting electrode or electrodes is/are directed towards the axis of rotation with the result that the generated plasma column is, at least at its upper end, of generally inverted conical shape. Since the outer ends of the electrodes in such arrangement are directed away from the axis of rotation, there need be no obstruction to a feedstock feed substantially on the axis of rotation. Assuming the path or locus of the orbiting electrode or electrodes to be in a generally horizontal plane parallel with, but above, the plane in which the stationary electrode lies, the top end of the plasma column generated when the electrode orbits at sufficient speed will have a shallow, somewhat bowl-shaped depression, into which the feedstock may be fed axially in relation to the stationary electrode for entry into the plasma column. This is a simpler and more effective arrangement than feeding the feedstock in a cylindrical curtain outwardly of the path of the orbiting electrode.

In some applications of the plasma arc furnace of this invention the stationary electrode may be formed by a bath of molten metal accumulating in the bottom of the furnace but for starting purposes the bottom of the furnace may itself form the stationary electrode or may be provided with a suitably positioned electrode.

In its simplest form, a plasma arc furnace constructed in accordance with the present invention incorporates a stationary electrode of a diameter smaller than the diameter of the path of the orbiting electrode so that the expanded plasma cone converges towards the stationary electrode, with the result that in the position of maximum energy the plasma is at or close to the plane of the stationary electrode.

In another arrangement, however, the orbiting electrode is directed across the axis of rotation and preferably at a diametrically opposed point on the stationary electrode, so that the generatrix defined by the line joining the orbiting electrode to the direction point on the stationary electrode, passes through the axis of the orbital path of the electrode. The surface defined by the movement of this generatrix will thus be seen to be two cones, joined at their apices and having bases of a diameter respectively corresponding to the diameter of the orbital path of the moving electrode and to the diameter of the stationary electrode. In this case the stationary electrode may be ring-shaped and may have a diameter which exceeds the diameter of the path of the orbiting electrode. The expanded plasma column generated by this apparatus thus has a constricted zone of high energy around the common apex of the notional conical surfaces mentioned above. All particulate material fed into the plasma column along its axis through the path of the orbiting electrode will pass through this zone of extra high energy. It should be understood that the particulate matter will follow a more or less spiral path because of the precessional movement of the plasma arising from its generation by a rapidly moving orbiting electrode.

It is one of the particular advantages of this arrangement that a radio-frequency coil and/or an electrode may be arranged around the constricted portion of the plasma zone and that the coil may be employed to couple additional energy to the plasma column.

Where the nature of a chemical process to be carried out in the plasma arc furnace of the present invention is such that the reactants should be brought together only when at least one of them has been raised above some predetermined critical high temperature, the constricted plasma zone provides a suitable position for the introduction of additional reactants and/or catalysts or other reaction-promoting additives. This can be achieved by directing streams of the materials, preferably entrained in a carrier gas, or possibly, liquid toward the axis of the plasma column. This would preferably be performed by arranging the introduction of separate streams of feed at three or more equiangular points around the axis of the plasma column and aimed at or at a small angle to the axis of the plasma column.

Figure 2:
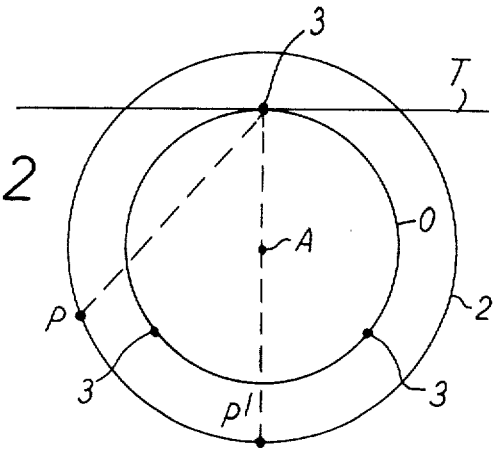

In the accompanying drawing,

FIG. 1 shows a diagrammatic vertical section of a plasma arc furnace of the present invention, primarily intended for the performance of highly endothermic chemical reactions, and FIG. 2 is an explanatory diagram.

The furnace includes a furnace body 1, in which is arranged a ring-shaped electrode structure 2, which may be a single ring or may be constructed in the form of a number of separate sections. However, the electrode must be substantially continuous, i.e., the spacing, if any, between separate sections should be small. The electrode structure is cooled by the passage of an internal stream of coolant, usually a hydrocarbon oil. An orbiting electrode 3, which may conveniently be a plasma gun of the constricted arc type or a non-consumable electrode, e.g. thoriated tungsten bathed in a stream of plasma-forming gas, is arranged on a support structure (not shown) which moves it around its circular orbit. Means are also provided for moving the electrode 3 longitudinally along its own axis towards and away from the electrode structure 2, both for start-up and for control during operation. The electrode 3 is preferably provided with means for automatic longitudinal movement during operation for the purpose of correction of changes in the plasma column parameters. The rotor, which carries the electrode 3, seals off the top of the furnace, except for the provision of a central aperture, through which feedstock material, particularly in the form of solid particles, is fed into the furnace.

The furnace body is provided with a collector 4. In cases where the products accumulating in collector 4 necessitate quenching, means for rapidly cooling such collected material are also provided. The collector 4 is preferably provided with a ring-shaped electrode or, alternatively, may itself act as an electrode for purposes to be explained later. The body is also provided with one or more gas efflux passages 5 and the bottom is provided with one or more conventional tap holes for the removal of molten materials from the collector.

It will be appreciated from the foregoing explanation that movement of the inwardly inclined electrode 3 at a sufficiently rapid angular velocity about the axis of the electrode structure 2 will lead to the generation of an expanded plasma column in a zone of the shape generally indicated at 6. It will be understood that the drive for the electrodecarrying rotor is capable of driving the rotor at an appropriate speed (usually in excess of 250 r.p.m.) for generating an expanded plasma column. It is one of the particular advantages of the arrangement that the upper end of the plasma column defines a generally bowl-shaped plasma-free zone 7, into which particulate material may be conveniently fed in the direction of arrow 8. it will be seen that the expanded plasma column has a zone of maximum convergence (and maximum energy) at the level indicated by the common apex of the cones shown in chain lines.

As already explained, it may be convenient and advantageous to introduce a supplementary material feed into the plasma column to bring a second material into contact with the main feedstock supply only after the particles of the main supply have reached the constricted central zone of the plasma column in a highly heated condition. The secondary feedstock supply would be introduced through ducts 9 (preferably three in number) arranged at equiangular spacing around the periphery of the furnace body. The ducts 9 may alternatively be employed for withdrawal of gaseous effluents. Separate ducts may be employed for introduction of feedstocks and for removal of gaseous effluents. In such case, the ducts for the two purposes are preferably arranged at different levels in the furnace body.

A radio frequency coil 10 may be incorporated for the purpose of coupling additional energy to the plasma column. Alternatively or additionally, a supplementary stationary counter electrode may be provided at this position for start-up purposes. The plasma column would initially be established between the supplementary counter electrode and the orbiting electrode and then be switched to the main stationary electrode 2. Alternatively, a stationary counter electrode at 10 may be treated as a first anode arranged at a lower potential than the second anode, constituted by the main stationary electrode 2 and remain at this potential during normal operation. In some instances, as already indicated, the collector 4 may constitute or include a further electrode; this further electrode could be connected as an anode at a higher potential than the counter electrode 2 and could be used instead of the electrode 2. In other instances, however, it is preferred that the electrode associated with collector 4 should be negative in relation to the counter electrode 2. This is particularly the case where the product to be collected is leaving the plasma zone in the form of positively charged ions or particles, which would be attracted to the collector electrode.

It is a particular feature of the present apparatus that very rapid expansion takes place under quasi-adiabatic conditions as the plasma descends from the zone of maximum constriction with the result that the effluent from the plasma zone, i.e. passing downwardly through electrode 2, leaves at a temperature much below the maximum temperature reached in the plasma zone. This, in conjunction with the use of a negatively charged collector bottom, allows the products of a highly endothermic metal ore reduction reaction to be separated from one another before appreciable reverse reaction has taken place. Reactions which do not suffer from the rapid reversal drawback but in which the required products are highly reactive or unstable and tend to undergo further undesired chemical changes also fall within this category. One of the most important advantages offered by the invention from the processing point of view is inherent in the fact that different reactants participating in a given reaction may require different time of residence in the plasma, and that in general introducing one of the reactants at a different position to the other in the plasma column and contacting the two over a critically controlled time and area may be beneficial in terms of effective product yield or product recovery. Whether such phenomena are primarily due to the time of residence in the plasma column and related to the presence of ionised or excited species or the nature of the contact occurring between the reactants or any other reasons is not clear at this stage. However, the ability to use in addition to the main means of feedstock injection (i.e. through the upper concavity) also other auxiliary means at different places, particularly in the vicinity of the convergence, is an important feature making it possible to critically control the operation of any process of the type mentioned above. It is important in this context to stress the nature of the plasma furnace installation in general, i.e., that it is a small-volume, high-throughput reactor and that for that reason alone, all reactions carried out in such a furnace in general, and those prone to reversal or tendency for further undesirable reactions in particular, can be attained much more efficiently than in orthodox furnaces if a high degree of control is achieved.

It is one of the particular advantages of the arrangement of the present invention that the number of the orbiting electrodes (which may rotate about their own axes or be stationary in relation thereto) can easily be increased without interfering with the desirable axial feedstock introduction. Thus, without increasing the dimensions of the rotating carrier in which the orbiting electrode is carried, three electrodes or plasma guns, with the necessary means for moving these along their individual axes, can be supported in the carrier and this permits an enormous increase in the energy introduced into the furnace. In such an arrangement it is not wholly necessary to direct each orbiting electrode at a diametrically opposite pointe on the stationary electrode structure.

The use of multiple electrodes is particularly advantageous where longitudinal movement of the electrodes in response to control instrumentalities is employed for stabilisation of the plasma column. If all electrodes move together the rotor will remain in balance and can be consistently rotated at high speed.

Referring to FiG. 2 it will be seen that the longitudinal movement of the orbiting electrodes will not lead to spatial difficulty, providing that the point P towards which the longitudinal axis of the electrode 3 is directed lies on the periphery of the major segment, defined by the intersection of the plane of the tangent T to the orbit O at the moving electrode 3 with the plane of the circular stationary electrode. However, in order to obtain maximum concentration of energy the electrodes 3 are directed at points P' at positions diametrically opposed thereto in relation to the axis A.

I claim:

1. In a plasma arc furnace comprising a furnace body, a stationary electrode mounted in said furnace body and at least one orbiting electrode movable in a substantially circular path, means for moving said electrode about its orbital axis of rotation with sufficient velocity to develop a radially-expanded plasma column in a zone lying between the path of said orbiting electrode and said stationary electrode and means for introducing feedstocks into the plasma column, the improvement which comprises directing the orbiting electrode inwardly toward the axis of rotation and at a point on the stationary electrode so as to generate a plasma column having a portion of generally inverted conical shape in the vicinity of the orbiting electrode.

2. A plasma arc furnace as claimed in claim 1 in which the orbiting electrode is directed across the axis of rotation whereby the generated plasma column is in the form of two generally conical portions meeting at a common apex.

3. A plasma arc furnace as claimed in claim 2 in which the orbiting electrode is directed across the axis of rotation and at a diametrically opposite point on the stationary electrode.

4. A plasma arc furnace as claimed in claim 2 in which the stationary electrode is ring-shaped.

5. A plasma arc furnace as claimed in claim 4 in which the diameter of the stationary electrode exceeds the diameter of the path of the orbiting electrode.

6. A plasma arc furnace as claimed in claim 2 in which there are at least three orbiting electrodes moving in a common path and arranged at equiangular spacing in said path.

7. A plasma arc furnace as claimed in claim 1 in which the orbiting electrode is arranged above the stationary electrode and the furnace is provided with a collector below the stationary electrode, said collector comprising or including a further electrode adapted to be maintained at a potential different to that of said stationary electrode.

8. A plasma arc furnace as claimed in claim 1 further comprising means for supplying feedstocks into the upper end of the plasma column through the path of the orbiting electrode.

9. A plasma arc furnace according to claim 6 further comprising auxiliary means for introduction of feedstock into the periphery of the plasma column.

10. A plasma arc furnace according to claim 2 further comprising a ring-shaped stationary electrode arranged co-axially with the axis of rotation and at a level corresponding substantially to the maximum convergence of the expanded plasma column.

11. A plasma arc furnace according to claim 2 further comprising a ring-shaped coil adapted to be energised with H.F. alternating current, said coil being arranged coaxially with the axis of rotation and at a level corresponding substantially to the maximum convergence of the expanded plasma column.

12. A plasma arc furnace according to claim 1 further comprising means for withdrawing gaseous products from within the furnace body.

* * * * *